United States Patent [19]

Smith

[11] Patent Number: 4,592,493

[45] Date of Patent: Jun. 3, 1986

[54] RECLOSABLE DISPENSER

[75] Inventor: Robert C. Smith, Short Hills, N.J.

[73] Assignee: Unette Corporation, Parsippany, N.J.

[21] Appl. No.: 661,115

[22] Filed: Oct. 15, 1984

[51] Int. Cl.[4] ..... B65D 37/00; B65D 5/72; F16K 31/00

[52] U.S. Cl. ..... 222/212; 222/498; 222/512; 251/75; 251/342

[58] Field of Search ..... 222/498, 541, 512, 212, 222/206, 213, 215, 213; 251/331, 342, 75

[56] References Cited

U.S. PATENT DOCUMENTS 2,815,150 12/1957 Herzig ..... 222/541 X 3,184,121 5/1965 Volckening ..... 222/541 X 3,635,376 1/1972 Hellstrom ..... 222/498 X 4,328,912 5/1982 Haggar et al. ..... 222/212

*Primary Examiner*—Joseph J. Rolla

*Assistant Examiner*—Gregory L. Huson

*Attorney, Agent, or Firm*—Brooks Haidt Haffner & Delahunty

[57] ABSTRACT

A tubular dispenser container having a dispensing passageway through a flat end seal provided with a valve formed of confronting, distended side wall portions having differing curvature which portions are flexed to one side of the end seal and to the other side to open and to close the passageway.

9 Claims, 9 Drawing Figures

RECLOSABLE DISPENSER

BACKGROUND OF THE INVENTION

The invention relates to the construction of a reclosable article for dispensing a contained material.

DESCRIPTION OF THE PRIOR ART

U.S. Pat. No. 2,663,461 discloses a dispensing type capsule for discharging a single dosage of a contained material, wherein the term, single dosage, refers to a predetermined amount which is to be substantially totally expelled for a single use purpose. The discharge end of the capsule is hermetically sealed by dipping the discharge end of the capsule momentarily into a body of a molten sealing substance in order to originally seal this end of the capsule.

More recently, dispensing type capsules have been made in which a dispensing passageway is formed integrally with the end closure utilizing dielectric welding. The end of a thermoplastic tube is placed between confronting flat electrode faces. As the side wall of the tube is compressed against itself between the electrode faces, a radio frequency voltage is applied across the electrodes to heat and weld together the inside tube walls wherever they are in contact.

A potential dispensing passageway can be formed by relieving one or both confronting electrode faces, so the inside walls of the tube are not in contact through a defined area connected to the interior of the tube. The passageway so formed is blind, in that it is not carried to the end of tube, and the tube end is thus sealed. The capsule so formed when filled with a material to be dispensed and sealed at its other end can be opened to discharge its contents by rupturing the passageway. Such rupture is facilitated by cutting a slit or forming a notch in the flattened, sealed side walls of the tube adjacent the dispensing passageway. U.S. Pat. No. D267,927 is illustrative of such a capsule.

Both of the above prior art methods, for originally closing and sealing a dispenser tube, are such that once the sealed end of the tube has been ruptured in order to permit the dispensing of the contained material, the ruptured end of the tube is so severely fractured that reclosing of the ruptured end in order to provide an airtight reseal is not feasible.

An important object of the present invention is to provide a reclosable article having a reclosable valve arrangement which is reliable, easy to manufacture, and readily incorporated in a dispenser for containing a wide variety of materials.

It is also an object of the present invention to provide a means to reclose a package after breaking open the original seal and using a portion of the contents of the package.

It is another object of the present invention to provide a dispenser with an end closure means permitting alternative opening and resealing of the end in a reversible manner, based upon movement of the closure means between a concave and a convex position.

SUMMARY OF THE INVENTION

In accordance with the present invention a dispenser package for a fluent material is formed from tubing having a flat sealed end closure containing a potential, but blind dispensing passageway leading from the interior of the tube. The passageway is opened by tearing, cutting or otherwise fracturing the end closure across the passageway.

Reclosing the passageway is accomplished by providing a valve created by welding a "bubble", which can be parti-spherical or parti-ellipsoidal in shape, into the sealed end of the package such that the "bubble" is included in the dispensing passageway between the potential location of the fracture and the interior of the tubing, thus dividing the dispensing passageway into an interior portion leading to the interior of the container and a blind end which is later fractured to open the container. The "bubble" in accordance with this invention includes a pair of aligned, stretched portions located in the sealed, dispensing end of the container, one in each of the confronting side walls of the container. These aligned, stretched portions are not welded together and hence the interior space between them communicates the interior portion of the dispensing passageway leading to the interior of the container with the blind end of the dispensing passageway leading into the end seal and which is designed to be ruptured or otherwise fractured in order to permit dispensing of the contents of the container. Since the side wall portions forming the "bubble" are stretched, they are distended from the flat configuration of the sealed side walls enclosing them, and each such stretched portion has an external configuration either as a bump or as a dimple in the side wall; a bump on one side of the container thus being aligned with a dimple on the other side of the container.

The stretched portions, moreover, are flexible and are reversible together alternately between the bump and the dimple configurations. The dimensions of the two stretched portions differ such that in one, closed configuration and arrangement the dimple on one side is forced into contact with the interior of the bump on the other side, and such that when the two portions are flexed to the opposite, open configuration arrangement the resultant dimple on the second side is out of contact with and spaced away from the interior of the bump on the first side.

The internal contact between the side walls of the stretched portions in the closed position prevents communication between the interior portion of the dispensing passageway and the blind end of the dispensing passageway. This communication is opened when the stretched portions are flexed to the second, open position in which interiorally the bump and dimple are spaced apart.

The reclosable dispenser package is utilized by tearing open the sealed end or otherwise fracturing the dispensing passageway. The dispensing passageway is then opened and closed by depressing the "bubble" to one side of the package or the other to select the open or the closed configurational arrangement of the pair of aligned, stretched side wall portions. The distended nature of the stretched portions, moreover, facilitates the transition between open and closed positions such that the transition occurs with what can best be described as a "snap" action, providing a tactile indication that the transition has occurred.

The "bubble" valve mechanism for opening and closing the dispensing end of the container package of the invention is conveniently formed simultaneously with sealing such end by dielectric welding. The confronting faces of the welding electrodes have the usual grooves to form the blind dispensing passageway when the confronting faces are pressed together, and radio frequency energy is applied across the electrodes otherwise to seal together the side walls of the tube from which the dispensing end of the container is formed.

In accordance with this invention a circular opening (female part) is formed in one electrode face leading into a hole in the electrode. A convex boss or button (male part) is formed in the second electrode face aligned with the opening in the first electrode face. Preferably the convex boss or button is parti-spherical.

The required difference in dimensions to form the "bubble" valve are achieved by forming the button on the second electrode with a radius of curvature preferably less than one-half of the diameter of the corresponding opening in the first electrode. In any event, the depth of the hole extending from the opening and the thickness of the convex boss or button are such that contacting plastic surfaces placed across the opening do not weld together even though the surfaces weld periferally about the opening where the electrode faces press such surfaces together. That is, the insides of the walls of the tube being sealed are not pressed together when the male part is juxtaposed to the female part during welding. The plastic surfaces between the opening and button stretch during welding, but only so as to form the aligned flexible dimple and bump that form the bubble shape of the valve in the discharge passageway of the container package. Although the dimple and bump are not welded together, they are pressed into tight sealing contact on cooling of the sealed end of the container subsequent to welding.

Generally speaking, the reclosable valve arrangement of the invention is based upon having two closely positioned adjacent distended surfaces of similar transverse dimensions but differing curvature which coact to form a valve. "Curvature" is meant to refer to the distention of the surfaces from the planar configuration of the surrounding welded tube end. Thus, the valve can be pushed one way to open, and then pushed in the opposite direction to reseal. When opening the valve, the surface with the lesser curvature is pushed toward the surface with the greater curvature, so as to create a gap or space between the surfaces for the discharge of the contents of the package.

To seal or reseal the package, the valve is pushed in the opposite direction such that the surface with the greater curvature is forced into contact with the surface with the lesser curvature, such that a fluid tight mating of the two surfaces will result, and will prevent the movement of the package contents past the point of contact.

More particularly, the present invention is directed to an article for dispensing a contained material comprising a tube having a first end and a second end, at least one of said ends having a discharge passageway with means for alternatively opening and closing passageway in a reversible manner, comprising a pair of aligned flexible distended portions movable between concave and convex positions, with one distended portion having a greater curvature than that of the other distended portion.

The dispensing container package of the present invention has the advantage of a securely sealed package with a frangible discharge passage which, after rupture of the discharge passageway can be resealed and opened in a reversible manner, with the closure device being an integral part of the package. Thus the closure device cannot become detached and possibly lost after opening the package, such as sometimes can happen to a detachable closure, such as a stopper plug or a screw-cap. This is because the flexible "bubble" valve is formed as an integral portion within the dispensing end of the container. The valve cannot become separated from the container, even after the original seal has been ruptured in order to initially dispense some of the contents of the container.

BRIEF DESCRIPTION OF THE DRAWINGS

These and other advantages and features of the reclosable dispensing container package of the invention are more fully set forth with reference to the accompanying figures of the drawings, in which.

DETAILED DESCRIPTION OF PREFERRED EMBODIMENTS

Figure 1:
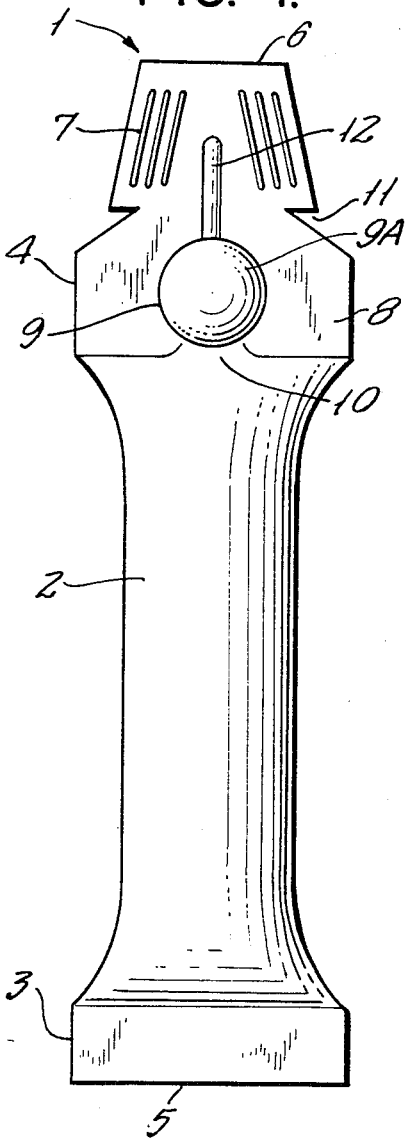
FIG. 1 is an elevation of a reclosable dispensing container of the invention before use.

FIG. 1 shows a reclosable dispensing container in accordance with the invention before initial opening and dispensing any of the contents of container 1. Container 1 is utilized for dispensing a contained fluent material, usually a liquid, and comprises a tube 2 having a bottom end 3 and a top end 4.

Bottom end 3 is closed by a nonrupturable seal 5, which is created by flattening the lower end 3 of the tube and then heat sealing the thus flattened portion of end 3 to produce a fluid tight closure at end 3, for example, by dielectric welding. End 4 comprises a sealed upper portion 6, which is in the shape of a cap and ribbing 7 for decorative purposes. The lower portion 8 of end 4 has a bubble valve 9 which is used to open and to close and again, as required, to reopen and reclose container tube 2 through a connecting passageway 10.

Upper portion 6 is separated from lower portion 8 of end 4 by a notched portion 11. A blind discharge passageway 12 extends upwardly from bubble 9 in lower portion 8 past the notched portion 11 into the upper portion 6 of end 4. Notched portion 11 is cut out of end 4 after end 4 has been sealed to insure that passageway 12 extends past portion 11.

In practice tube 2 is formed from a continuous length of thermoplastic tubing. Preferably "SARAN" tubing is used because of its low vapor transmission properties, but other thermoplastics can also be used, as is well known. "SARAN" is a copolymer of vinyl chloride and vinylidene chloride. Sealed end 4 is formed first. A length of tubing including end 4 is then cut off and filled with liquid or other fluent material to be contained in container 1. The tubing is filled in a position inverted from that shown in FIG. 1, and is then sealed at the open end by dielectric welding to form bottom end 3, preferably keeping the flattened surfaces of ends 3 and 4 coplanar.

Figure 2:
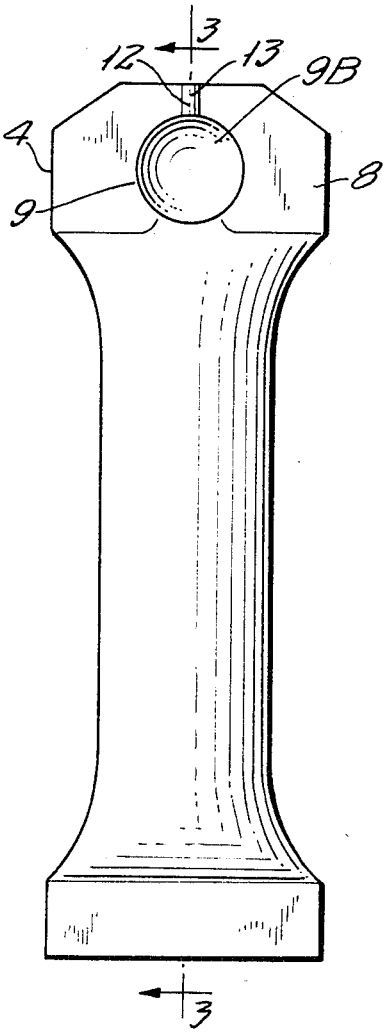
FIG. 2 is an elevation of the reclosable dispenser container of FIG. 1, with the end seal torn open and with the bubble valve indented to permit dispensing.

FIG. 2 illustrates container 1 with upper portion 6 torn off and removed along notched portion 11 thereby creating a discharge orifice opening 13 within discharge passageway 12. Thus, end 4 of FIG. 1 is reduced in size such that only the bottom portion 8 remains. Connection between passageway 10 and passageway 12 is normally blocked by bubble valve 9, as more fully described later, which is formed initially in a closed position and its surface 16 appears as a bump 9A, as seen in FIG. 1. To open valve 9, bump 9A is depressed to flex surface 16 and its aligned counterpart 17 in the obverse side of lower portion 8 thus forming a dimple 9B, as shown in FIG. 2.

Figure 3:
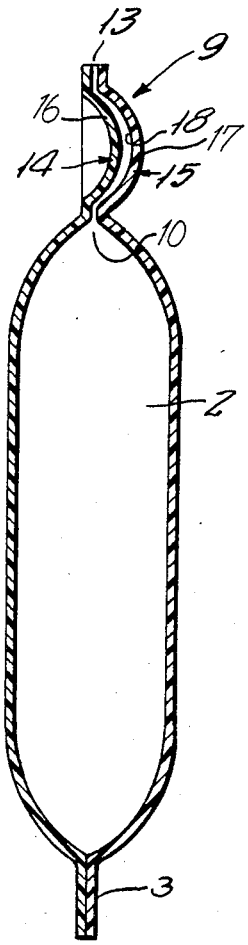
FIG. 3 is a section along line 3—3 of FIG. 2 showing the bubble valve in the open position.

As shown in FIG. 3, the remaining end portion 8 after tearing off end cap 6 includes a discharge orifice 13 through which any fluent material contained within tube 2 can be dispensed. Flexible bubble valve 9 is positioned between the body portion of tube 2, with which it communicates through passageway 10, and discharge orifice 13 and thus controls the flow of fluent material from tube 2. Bubble valve 9, as shown in FIG. 3, is in its open position such that bubble valve 9 is capable of permitting the fluent material in the tube 2 to flow out through the discharge orifice 13 when sufficient pressure is applied to the walls of tube 2.

Figure 5:
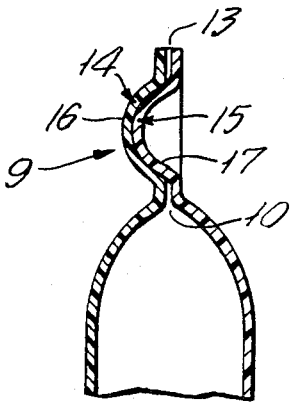
FIG. 5 is a section along line 5—5 of FIG. 4.

As shown in FIG. 5, bubble valve 9 comprises a distended side wall portion 14 having an outer surface 16 and an indented side wall portion 15 having an outer surface 17. Because the tube 2 is formed from a continuous length of thermoplastic tubing, the side wall portions 14 and 15 have substantially equal thickness. Side wall portion 14 in the valve-opened position as shown in FIG. 3 is spaced apart from side wall portion 15, since the curvature of side wall portion 14 is less than that of portion 15. Thus, the contained fluent material can eit body portion 2 of dispenser 1 through a throat 18 formed between side wall portions 14 and 15.

Figure 4:
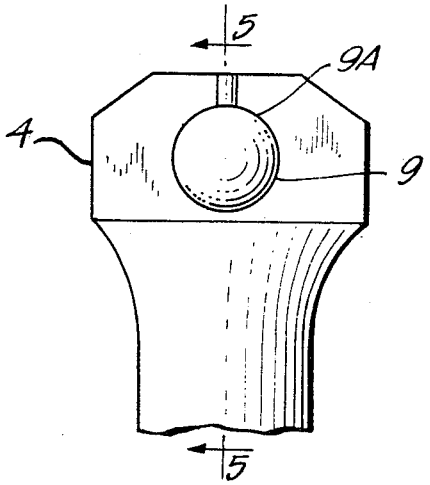
FIG. 4 is a fragmentary elevation of the dispensing end of the reclosable container of FIG. 1, with the end seal torn open and the bubble valve in closed position.

After the amount of contained material which is immediately required has been dispensed through open throat 18 and orifice 13, bubble valve 9 can be restored to its normal, closed position by pressing outer surfaces 16 and 17 to flex them to their alternate position in which surface 16 forms bump 9A and surface 17 is reconfigured as a dimple, as shown in FIGS. 4 and 5. As can best be seen in FIG. 5, the curvature of distended side wall portion 14 being less than the curvature of indented side wall portion 15, the result of flexing to the position shown in FIG. 5 brings side wall portion 15 into contact with the inside of side wall portion 14 and thus closes throat 18 to reseal bubble valve 9 and thereby container 1. Bubble valve 9 can be reopened and reclosed as often as desired simply by flexing distended and indented side wall portions 14 and 15 as described above.

Figure 6:
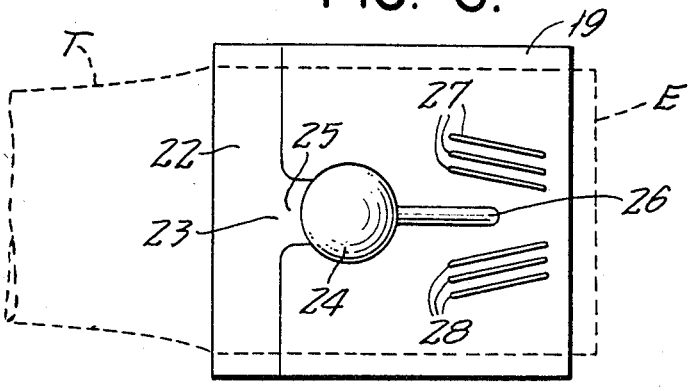
FIG. 6 is a plan view of the front die face for producing the end seal and bubble valve of the container shown in FIG. 1.
Figure 7:
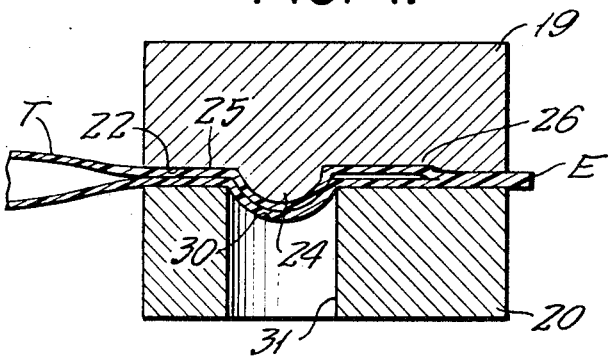
FIG. 7 is a section of the front die of FIG. 6 and of a back up die pressing a container tube therebetween.
Figure 8:
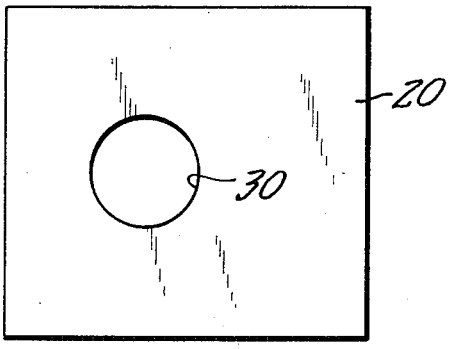
FIG. 8 is a plan view of the back up die face of FIG. 7.

FIGS. 6, 7, and 8 illustrate a method of manufacturing a dispensing end seal containing a flexible bubble valve in accordance with this invention. In general, the reference numeral 19 denotes a front die and the reference numeral 20 denotes a back-up die which are formed in confronting faces of a pair of electrodes connected to dielectric welding apparatus (otherwise not shown). Dies 19 and 20 can be pressed together, as shown in FIG. 7, with the end E of a length of tubing T between them to weld together confronting inside surfaces of tubing T which are flattened into contact with each other by the pressure of confronting dies 19 and 20. Welding takes place when the electrodes on which dies 19 and 20 are formed are suitably energized with radio frequency energy.

Front die 19, as shown in FIG. 6, is wider than the transverse dimension of flattened tubing T. The positioning of end E of tubing T, as it is intended to be received across the face of die 19, is indicated in dashed lines in FIG. 6. As can be seen tubing T is intended to extend across die 19 from its left side with end E on the right side of die 19. Accordingly, a shallow relief 22 in die 19 leads into the face of die 19 from the left side extending about a third of the way across the face of die 19 with an apex 23 lying on the horizontal center line of die 19, as shown in FIG. 6. A parti-spherical boss 24 extends upwardly from the flat face of die 19 at its center.

The diameter of boss 24 at its base is substantially less than the transverse dimension of flattened tubing T, and, as will be apparent below, is shaped to form the dimple in bubble valve 9 on the obverse side of container 1 as shown in FIG. 1. The left side of boss 24 is further spaced a short distance from apex 23 of relief 22, and a narrow relief 25 is cut in the face of die 19 extending from apex 23 up to boss 24. An extension 26 of relief 25 is formed in die 19 diametrically across boss 24. Extension 26 terminates well short of the intended location of end 6 of the container 1 to be formed. Two sets 27 and 28 of short parallel lines are engraved in the face of die 19 within the intended confines of end portion 6 on opposite sides of extension 26 located above and below extension 26 as seen in FIG. 6.

Generally, the depth of each relief 22, 25 and 26 is the same. The face of die 20 is flat, and, as can be seen by reference to FIGS. 7 and 8, the electrode on wnhich die 20 is formed is centrally drilled providing an opening 30 in the center of die 20 which, when dies 19 and 20 are brought together to confront each other, is aligned with boss 24 and is sized to permit entry of boss 24 into opening 30. The drilled hole 31 forming opening 30 is deeper than male boss 24. When dies 19 and 20 are pressed together flattening a section of tubing T between them, the portions of tubing T extending over boss 24 and across opening 30, while in contact, are not pressed together.

It will be apparent from the preceding description of the shape of dies 19 and 20 that an end seal 4 for the dispensing end of a container 1 can be formed in tubing T by positioning tubing T between the confronting faces of dies 19 and 20 and then bringing the dies together to flatten tubing T between them generally as shown in FIGS. 6 and 7. As dies 19 and 20 are pressed against flattened tubing T, the pressure exerted by dies 19 and 20 holds the inside of the flattened side walls of tubing T together firmly except in those areas in which die 19 is relieved at 22, 25 and 26, except where the face of die 19 is engraved with the two sets of lines 27 and 28, and except across boss 24 and opening 30.

When radio frequency energy is then supplied across the electrodes on which dies 19 and 20 are formed in a conventional manner, thermoplastic tubing T is heated to within its melt range and welds together forming a flattened sealed portion 34, shown in FIG. 9, joined to a section S of unwelded tubing T subsequently to form tube body 2, formed by relief 22. The pressure of confronting dies 19 and 20 causes some flow of the thermoplastic material. The plastic thus stretches to conform to relieved portions of dies 19 and 20. Internal passageway 10 is thus formed where die face 19 is relieved at 25; blind passageway 12 is formed where die 19 is relieved at 26; and a bubble valve 9 is formed in the spaces between boss 24 and hole 31. Additionally, the plastic flows into the sets of spaces between the side walls of tubing T where ribs 7 are formed where sets 27 and 28 of engraved parallel lines are located. Side wall portions 14 and 15 stretch in the space across boss 24 and hole 31 during the welding operation, becoming distended and do not weld. Portions 14 and 15 are forced into internal sealing contact with each other as tubing T cools after the welding operation and shrinks against boss 24 to provide the firm seal described with reference to FIGS. 4 and 5.

Figure 9:
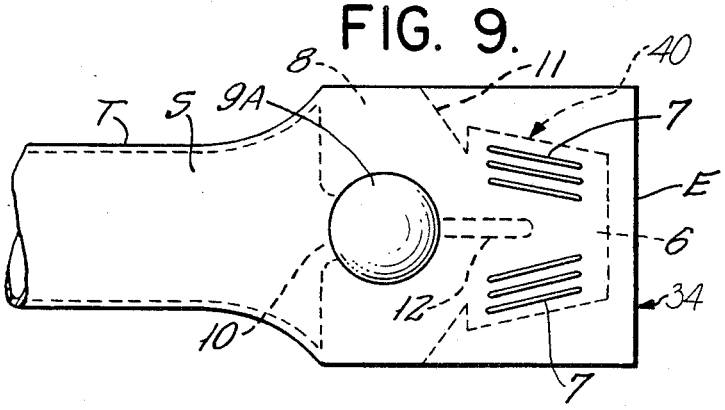
FIG. 9 is a fragmentary elevation of the sealed tube closure formed between the dies as shown in FIG. 7.

As can be seen with reference to FIG. 9, end seal 40 is given its final shape by trimming the welded flattened end E of tubing T subsequent to the welding operation particularly to form notches 11 which assure that when end portion 6 is torn off and separated from the remainder of container 1, as shown in FIG. 2, the tear will be across blind passageway 12 and thereby assure rupture of passageway 12 and formation of orifice 13. For decorative purposes end E can be further trimmed, for example, to simulate a screw cap in the finished end portion 6.

I claim:

1. A reclosable article for containing and dispensing a fluent material comprising a tubular container for containing a fluent material, the side walls of said container at one end thereof having substantially equal thickness and being compressed against themselves with substantial portions of the confronting interior surfaces of said side walls being sealed together to define a generally flat sealed end closing said one end of said container, and having a blind unsealed passageway between said sealed surfaces communicating with the interior of said container and extending into and terminating within said sealed end, valve means between said sealed surfaces and intersecting said passageway and including a pair of aligned, confronting and unsealed, respectively indented and distended wall portions forming a bubble projecting on one side of said sealed end and a corresponding dimple on the other side of said sealed end defining a closed position of said valve, said distended wall portion being disposed on one side of said end and said indented wall portion being disposed on the other side of said end, said confronting wall portions being flexible upon finger pressure being applied thereto to move said valve alternately between its said valve-closed position in which said bubble projects on said one side of said sealed end and a valve-opened position in which said bubble projects fully on said other side of said sealed end and a corresponding dimple is formed on said one side of said end, said confronting wall portions being similarly configured with said distended wall portion having a curvature which is greater than that of said indented wall portion whereby when said wall portions are in said valve-opened position a space is formed between said curvatures of said confronting wall portions communicating through said passageway and whereby when said confronting wall portions are in said valve-closed position said wall portions press against each other to close communication through said passageway.

2. A reclosable article according to claim 1 which further comprises means defining a notch in an edge of said end seal adjacent to, and within the length of said passageway.

3. A reclosable article according to claim 1 in which said distended and indented wall portions are parti-spherical and concentric.

4. An article according to claim 1 which is further provided with a seal at the other end of said container.

5. An article according to claim 4 in which said seal at said other end of said container comprises said container being compressed against itself at said other end with the confronting interior surfaces of the side walls being sealed together to define a flat sealed end.

6. An end seal for a tube which comprises the side walls of a tube at an end thereof having substantially equal thickness and being compressed against themselves with substantial portions of the confronting interior surfaces of said side walls being sealed together to define a generally flat sealed end, and having a blind unsealed passageway between said sealed surfaces communicating with the interior of said tube and extending into and terminating within said sealed end, valve means between said sealed surfaces and intersecting said passageway and including a pair of aligned, confronting and unsealed, respectively indented and distended wall portions having a bubble projecting on one side of said sealed end and a corresponding dimple on the other side of said sealed end defining a closed position of said valve, said distended wall portion being disposed on one side of said end and said indented wall portion being disposed on the other side of said end, said confronting wall portions being flexible upon finger pressure being applied thereto to move said valve alternately between its said valve-closed position in which said bubble projects on said one side of said sealed end and a valve-opened position in which said bubble projects fully on said other side of said sealed end and a corresponding dimple is formed on said one side of said end, said confronting wall portions being similarly configured with said distended wall portion having a curvature which is greater than that of said indented wall portion whereby when said wall portions are in said valve-opened position a space is formed between said confronting wall portions communicating through said passageway and whereby when said confronting wall portions are in said valve-closed position said wall portions press against each other to close communication through said passageway.

7. An end seal according to claim 6 which further comprises means defining a notch in an edge of said end seal at a locaion adjacent to and within the length of said passageway.

8. An end seal according to claim 6 in which said distended and indented wall portions are parti-spherical and concentric.

9. In a dispensing end seal for a tube which comprises the side walls of a tube at the end thereof having substantially equal thickness and being compressed against themselves with substantial portions of the confronting interior surfaces of said side walls being sealed together to define a generally flat sealed end and an unsealed dispensing passageway between said sealed surfaces extending between the interior and exterior of said tube, valve means between said sealed surfaces and intersecting said passageway and including a pair of aligned, confronting and unsealed, respectively indented and distended wall portions having a bubble projecting on one side of said sealed end and a corresponding dimple on the other side of said sealed end and defining a closed position of said valve, said distended wall portion being disposed on one side of said end and said indented wall portion being disposed on the other side of said end, said confronting wall portions being flexible upon finger pressure being applied thereto to move said valve alternately between its said valve-closed position in which said bubble projects on said one side of said sealed end and a valve-opened position in which said bubble projects fully on said other side of said sealed end and a corresponding dimple is formed on said one side of said end, said confronting wall portions being similarly configured with said distended wall portion having a curvature which is greater than that of said indented wall portion whereby when said wall portions are in said valve-opened position a space is formed between said confronting wall portions communicating through said passageway and whereby when said confronting wall portions are in said valve-closed position said wall portions press against each other to close communication through said passageway.

* * * * *